US008842142B2

(12) United States Patent
Bouverie et al.

(10) Patent No.: US 8,842,142 B2
(45) **Date of Patent: *Sep. 23, 2014**

(54) PRINT STATION SYSTEM

(75) Inventors: William M. Bouverie, Windermere, FL (US); Mark Allen Hitz, Rock Hill, SC (US); Richard Hatle, Oviedo, FL (US); Dwayne Steven Tobin, Longwood, FL (US); Marjorie Hitz, legal representative, Rock Hill, SC (US)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/565,874

(22) Filed: Aug. 3, 2012

(65) Prior Publication Data

US 2013/0033554 A1 Feb. 7, 2013

Related U.S. Application Data

(60) Provisional application No. 61/515,354, filed on Aug. 5, 2011.

(51) Int. Cl.
*B41J 2/35* (2006.01)

(52) U.S. Cl.
CPC ..... *B41J 2/35* (2013.01)
USPC ..... 347/178; 347/220; 347/215; 347/211; 347/7; 400/693.1; 400/691; 400/223; 400/621; 400/236

(58) Field of Classification Search
USPC ..... 347/170–174; 271/2
See application file for complete search history.

(56) References Cited

U.S. PATENT DOCUMENTS

| | | | | |
|---|---|---|---|---|
| 4,143,977 | A | 3/1979 | Kurihara et al. | |
| 4,177,731 | A | 12/1979 | Kleist et al. | |
| 4,227,819 | A * | 10/1980 | Manriquez | 400/56 |
| 4,732,502 | A * | 3/1988 | Yokoi | 400/693 |
| 4,788,558 | A | 11/1988 | Caldwell et al. | |
| 4,788,559 | A | 11/1988 | Ende | |
| 4,872,659 | A | 10/1989 | Kato et al. | |
| 4,924,240 | A | 5/1990 | Herbert et al. | |
| 4,944,621 | A * | 7/1990 | Uecker | 400/691 |
| 4,991,846 | A | 2/1991 | Sondej | |

(Continued)

FOREIGN PATENT DOCUMENTS

JP 04552558 B2 9/2010

OTHER PUBLICATIONS

Written Opinion of the International Searching Authority, PCT/US2012/036297, Jul. 17, 2012.

(Continued)

*Primary Examiner* — Matthew Luu
*Assistant Examiner* — Lily Kemathe
(74) *Attorney, Agent, or Firm* — Carter, DeLuca, Farrell & Schmidt, LLP

(57) ABSTRACT

A print station system having a chassis for housing a modular print station; a power source in communication with the print station; a controller circuit card assembly in communication with the print station; a display panel in communication with the print station; a media rewind hub; a pair of adjustable media guides connected about a base of the print station; and at least one sensor affixed to the print station base and being operable for detecting the presence and position of media passing through a media feed path of the print station system.

20 Claims, 16 Drawing Sheets

(56) References Cited

U.S. PATENT DOCUMENTS

| | | | | |
|---|---|---|---|---|
| 5,028,155 | A | 7/1991 | Sugiura et al. | |
| 5,087,137 | A | 2/1992 | Burnard et al. | |
| 5,206,662 | A | 4/1993 | Fox et al. | |
| 5,326,182 | A | 7/1994 | Hagstrom | |
| 5,397,192 | A | 3/1995 | Khormaee | |
| 5,468,076 | A | 11/1995 | Hirano et al. | |
| 5,490,638 | A | 2/1996 | Driftmyer et al. | |
| 5,499,878 | A * | 3/1996 | Morgavi | 400/223 |
| 5,507,583 | A * | 4/1996 | Beaty et al. | 400/611 |
| 5,529,410 | A * | 6/1996 | Hunter et al. | 400/234 |
| 5,564,841 | A | 10/1996 | Austin et al. | |
| 5,564,845 | A * | 10/1996 | Yamaguchi et al. | 400/582 |
| 5,600,350 | A | 2/1997 | Cobbs et al. | |
| 5,650,730 | A | 7/1997 | Herbst, Jr. | |
| 5,684,516 | A | 11/1997 | Cseledy et al. | |
| 5,790,162 | A | 8/1998 | Adams et al. | |
| 5,820,280 | A | 10/1998 | Fox | |
| 5,836,704 | A | 11/1998 | Lau et al. | |
| 5,870,114 | A | 2/1999 | Numata et al. | |
| 5,872,585 | A | 2/1999 | Donato et al. | |
| 5,874,980 | A | 2/1999 | West | |
| 5,909,233 | A | 6/1999 | Hamman et al. | |
| 5,927,875 | A | 7/1999 | Lau et al. | |
| 5,978,004 | A | 11/1999 | Ehrhardt | |
| 5,995,128 | A | 11/1999 | Adams et al. | |
| 6,014,229 | A | 1/2000 | Yun | |
| 6,020,906 | A | 2/2000 | Adams et al. | |
| 6,034,708 | A | 3/2000 | Adams et al. | |
| 6,057,870 | A | 5/2000 | Monnier et al. | |
| 6,070,048 | A | 5/2000 | Nonaka et al. | |
| 6,082,914 | A | 7/2000 | Barrus et al. | |
| 6,095,704 | A | 8/2000 | Jaeger et al. | |
| 6,099,178 | A | 8/2000 | Spurr et al. | |
| 6,129,463 | A | 10/2000 | Lau et al. | |
| 6,201,255 | B1 | 3/2001 | Torchalski et al. | |
| 6,283,024 | B1 | 9/2001 | George | |
| 6,289,730 | B1 | 9/2001 | Elgee | |
| 6,302,604 | B1 | 10/2001 | Bryant et al. | |
| 6,315,471 | B1 * | 11/2001 | Hsieh et al. | 400/234 |
| 6,389,241 | B1 | 5/2002 | Cernusak et al. | |
| 6,396,070 | B1 | 5/2002 | Christensen et al. | |
| 6,520,614 | B2 | 2/2003 | Kaneko | |
| 6,616,362 | B2 | 9/2003 | Bouverie et al. | |
| 6,824,322 | B2 * | 11/2004 | Miyajima | 400/621 |
| 6,825,864 | B2 | 11/2004 | Botten et al. | |
| 6,840,689 | B2 | 1/2005 | Barrus et al. | |
| 6,846,121 | B2 | 1/2005 | Bouverie et al. | |
| 6,857,714 | B2 | 2/2005 | Hohberger et al. | |
| 6,900,449 | B2 | 5/2005 | Bolash et al. | |
| 6,942,403 | B2 | 9/2005 | Hohberger et al. | |
| 7,042,478 | B2 | 5/2006 | Bouverie et al. | |
| 7,071,961 | B2 | 7/2006 | Ullenius et al. | |
| 7,079,168 | B2 | 7/2006 | Ullenius et al. | |
| 7,150,572 | B2 | 12/2006 | McNestry et al. | |
| 7,162,460 | B2 | 1/2007 | Cleckler et al. | |
| 7,205,561 | B2 | 4/2007 | Chelvayohan et al. | |
| 7,255,343 | B2 | 8/2007 | So | |
| 7,375,832 | B2 | 5/2008 | Bouverie et al. | |
| 7,456,995 | B2 | 11/2008 | Stephens | |
| 7,502,042 | B2 | 3/2009 | Hitz et al. | |
| 7,537,404 | B2 | 5/2009 | Bouverie et al. | |
| 7,600,684 | B2 | 10/2009 | Tobin et al. | |
| 7,667,874 | B2 | 2/2010 | MacDonald et al. | |
| 7,699,550 | B2 | 4/2010 | Bouverie et al. | |
| 7,824,116 | B2 | 11/2010 | Lyman | |
| 7,845,632 | B2 | 12/2010 | Windsor et al. | |
| 7,857,414 | B2 | 12/2010 | Eun et al. | |
| 7,876,223 | B2 | 1/2011 | Yamaguchi et al. | |
| 7,891,892 | B2 | 2/2011 | Chiu | |
| 7,907,159 | B2 | 3/2011 | Matsuo et al. | |
| 7,934,881 | B2 | 5/2011 | Lodwig et al. | |
| 7,938,501 | B2 | 5/2011 | Takamiya et al. | |
| 8,142,087 | B2 | 3/2012 | Kugimachi | |
| 2001/0008612 | A1 | 7/2001 | Liljestrand et al. | |
| 2003/0081024 | A1 | 5/2003 | Vives et al. | |
| 2003/0141655 | A1 | 7/2003 | Bryer | |
| 2004/0008365 | A1 | 1/2004 | Hobbs | |
| 2004/0114024 | A1 | 6/2004 | Bouverie et al. | |
| 2004/0165927 | A1 | 8/2004 | Fisher et al. | |
| 2005/0002715 | A1 | 1/2005 | Fries et al. | |
| 2005/0189693 | A1 | 9/2005 | Ko | |
| 2005/0190368 | A1 | 9/2005 | Ehrhardt, Jr. et al. | |
| 2005/0204940 | A1 | 9/2005 | Elliott et al. | |
| 2006/0007295 | A1 | 1/2006 | Ueda | |
| 2006/0045601 | A1 | 3/2006 | Endo | |
| 2006/0055721 | A1 | 3/2006 | Burdette et al. | |
| 2006/0157911 | A1 | 7/2006 | Learmonth et al. | |
| 2006/0159504 | A1 | 7/2006 | Blanchard et al. | |
| 2006/0180737 | A1 | 8/2006 | Consiglio | |
| 2007/0022233 | A1 | 1/2007 | Bridges et al. | |
| 2007/0040326 | A1 | 2/2007 | Noda et al. | |
| 2007/0059078 | A1 | 3/2007 | Silverbrook et al. | |
| 2007/0138738 | A1 | 6/2007 | Motohashi et al. | |
| 2009/0038495 | A1 | 2/2009 | Butzen et al. | |
| 2009/0103806 | A1 | 4/2009 | Nakami | |
| 2009/0244584 | A1 | 10/2009 | McGarry et al. | |
| 2010/0066782 | A1 | 3/2010 | Yamamoto et al. | |
| 2010/0085396 | A1 * | 4/2010 | Yokota et al. | 347/7 |
| 2010/0135709 | A1 * | 6/2010 | McNestry et al. | 400/236 |
| 2010/0141721 | A1 * | 6/2010 | Koseki | 347/92 |
| 2010/0169513 | A1 | 7/2010 | Levin | |
| 2010/0238238 | A1 * | 9/2010 | Yamamoto | 347/85 |
| 2010/0247222 | A1 * | 9/2010 | Bouverie et al. | 400/693.1 |
| 2010/0319561 | A1 | 12/2010 | Colquitt et al. | |
| 2011/0012977 | A1 * | 1/2011 | McNestry et al. | 347/215 |
| 2011/0042883 | A1 | 2/2011 | Wang et al. | |
| 2011/0132643 | A1 | 6/2011 | Hattori et al. | |
| 2011/0222951 | A1 * | 9/2011 | Yahata et al. | 400/645.2 |
| 2012/0281053 | A1 * | 11/2012 | Kubota | 347/211 |
| 2012/0306986 | A1 * | 12/2012 | Bouverie et al. | 347/215 |
| 2012/0327168 | A1 * | 12/2012 | Bouverie et al. | 347/220 |

OTHER PUBLICATIONS

Written Opinion of the International Searching Authority, PCT/US2012/039043, Aug. 3, 2012.

Written Opinion of the International Searching Authority, PCT/US2012/041093, Aug. 7, 2012.

Written Opinion of the International Searching Authority, PCT/US2012/043734, Sep. 21, 2012.

Written Opinion of the International Searching Authority, PCT/US2012/043709, Sep. 21, 2012.

Written Opinion of the International Searching Authority, PCT/US2012/043772, Sep. 14, 2012.

Written Opinion of the International Searching Authority, PCT/US2012/046712, Oct. 5, 2012.

Written Opinion of the International Searching Authority, PCT/US2012/049417, Nov. 2, 2012.

Written Opinion of the International Searching Authority, PCT/US2012/050938, Nov. 6, 2012.

Written Opinion of the International Searching Authority, PCT/US2012/060956, Jan. 11, 2013.

Written Opinion of the International Searching Authority, PCT/US2012/066291, Feb. 5, 2013.

* cited by examiner

PRINT STATION SYSTEM

CROSS-REFERENCE TO RELATED APPLICATION(S)

This application claims priority to provisional patent application No. 61/515,354, filed Aug. 5, 2011, and entitled "Print Station System", the contents of which are incorporated in full by reference herein.

FIELD OF INVENTION

The present invention generally relates to the field of image forming apparatus and devices, and in particular, to a print station system used in a thermal transfer printing system.

BACKGROUND

Printing systems such as copiers, printers, facsimile devices or other systems having a print engine for creating visual images, graphics, texts, etc. on a page or other printable medium typically include various media feeding systems for introducing original image media or printable media into the system. Examples include thermal transfer printers. Typically, a thermal transfer printer is a printer which prints on media by melting a coating of ribbon so that it stays glued to the media on which the print is applied. It contrasts with direct thermal printing where no ribbon is present in the process. Typically, thermal transfer printers include a print station system which includes a supply spindle operable for supplying a media web and ribbon, a print station, and a take up spindle. New ribbon and media is fed from the supply spindle to the print station for printing and then the ribbon is wound up by the take up spindle while the media is exited from the print station system.

Problems with current printing systems, however, include within the print station alignment and compression issues which may result in faulty or defective printing. Additionally, the ability to maintain a tight media web in the print station has been identified as a problem in conventional print stations. Finally, media movement during a printing operation has been identified as an issue within print stations which could be improved.

Accordingly, it would be desirable to provide a print station system operable for use within a thermal transfer printing system which may be utilized in conjunction with as variety of media types and sizes and which compensates for alignment and compression issues. Additionally, it would be desirable to provide a print station system which has the ability to maintain a tight media web. Finally, it would be desirable to provide a print station system that is configured to limit media movement.

SUMMARY OF THE INVENTION

The present invention is designed to overcome the deficiencies and shortcomings of the systems and devices conventionally known and described above. The present invention is designed to reduce the manufacturing costs and the complexity of assembly. In all exemplary embodiments, the present invention provides a print station system that may be utilized in conjunction with a variety media types and sizes and which overcomes the noted shortcomings of existing systems by combining with a novel "stand alone" print station having various options containing features which expand the overall functionality of the printing system.

In all exemplary embodiments, the print station system of the present invention generally includes a chassis having a display panel thereon and being configured for housing a modular or "stand alone" print station; a power source in communication with the print station; a controller circuit card assembly in communication with the print station; a pair of adjustable media guides connected about a base of the print station, the media guides being axially spaced apart along the length of the base and being configured and adapted such that they can be manipulated or moved along a horizontal axis of the base in a sliding manner and in a synchronized manner; and a ribbon drive assembly for assisting in the control of the tension of media as it passes through a feed path of the print station system.

In exemplary embodiments, the print station comprises a drive-stepper motor; a platen roller in operative communication with the drive-stepper motor; a pinch roller in operative communication with the drive-stepper motor; a top-of-form sensor located between the platen roller and the pinch roller, wherein the top-of-form sensor allows for sensing of indicators on a media; a rocker arm in operative communication with the platen roller and the pinch roller; a printhead assembly having: a thermal printhead, a compression spring, and a printhead pressure adjustment sensor in communication with the compression spring; a media guide having media loading sensors in communication with the printhead pressure adjustment assembly for guiding the media into the print station; a radio-frequency identification antenna substantially located between the main platen roller and the pinch roller In other example embodiments, the pair of media guides include a sensor affixed to the base, the sensor being operable for emitting at least one light beam through at least one aperture located in the base, wherein at least one of the media guides are provided with a tab or other obstruction which is operable for protruding into the path of at least one of the light beams emitted from the sensor at defined locations, thereby signaling the sensor and the printer of the media's width.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present exemplary embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the detailed description, serve to explain the principles and operations thereof.

BRIEF DESCRIPTION OF THE DRAWINGS

The present subject matter may take form in various components and arrangements of components, and in various steps and arrangements of steps. The appended drawings are only for purposes of illustrating exemplary embodiments and are not to be construed as limiting the subject matter.

DETAILED DESCRIPTION OF THE EMBODIMENTS

The present invention will now be described more fully hereinafter with reference to the accompanying drawings in which exemplary embodiments of the invention are shown. However, this invention may be embodied in many different forms and should not be construed as limited to the embodiments set forth herein. These exemplary embodiments are provided so that this disclosure will be both thorough and complete, and will fully convey the scope of the invention to those skilled in the art. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Figure 1:
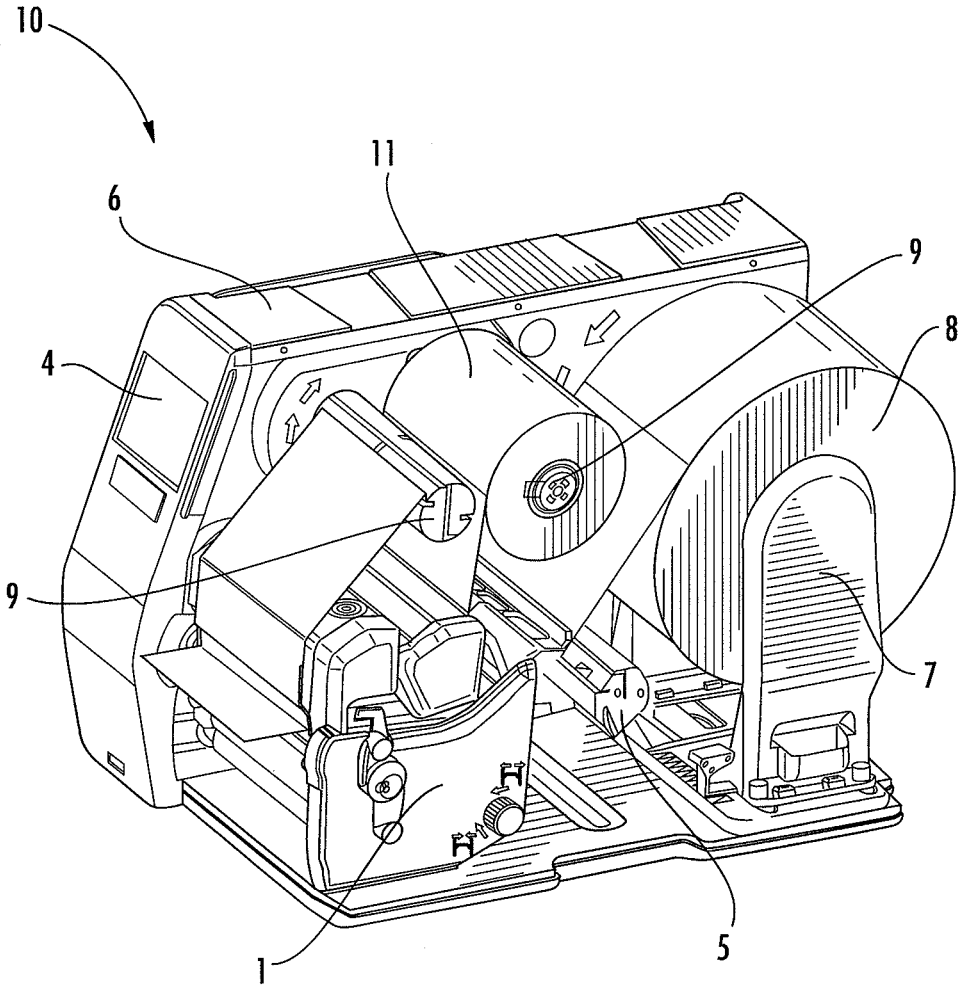
FIG. 1 is a front perspective view of a print station system constructed in accordance with one example embodiment of the present disclosure.
Figure 2:
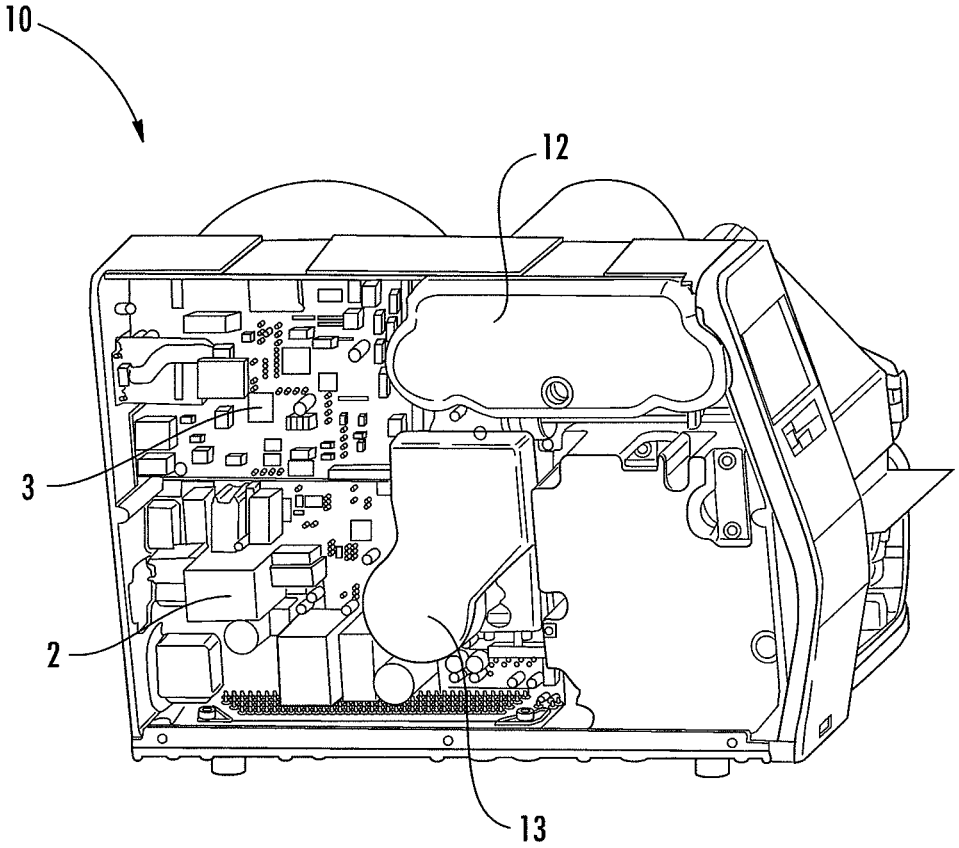
FIG. 2 is a rear perspective view of the embodiment of FIG. 1.

Referring now to the drawings, FIGS. 1 and 2 are varying views of an exemplary embodiment of a print station system 10 which is used as part of a printing system of the present invention. The print station system 10 may include a printer chassis 6 adapted for housing a modular or "stand alone" print station 1, a power source 2 in operative communication with the print station system 10 components, a controller circuit card assembly 3, a display panel 4, and a media rewind hub 5 in a printer chassis 6. The print station system 10 may also include a media hanger/hub 7 for housing a media supply roll 8 and a ribbon supply hub 9 for holding a ribbon supply roll 11.

The power source 2 may be of any type or configuration including, but not limited to, an external power source, an internal power source, alternative current, direct current, battery, etc. The power source 2 provides a sufficient amount of power to operate the print station system 10.

The display panel 4 is in operative communication with the print station 1 and the control circuitry 3 for the printer. Further, the display panel 4 may be of any type and configuration. By way of non-limiting example, the display panel may be liquid crystal display (LCD), plasma, or any other type. Moreover, the display panel 4 may be touch activated. Additionally or in the alternative, the display panel 4 may be operatively connected to at least one button or other input wherein a user may input data or other information into the print station system 10. Moreover, the display panel 4 may be secured on or within the chassis 6, connected to the print station 1, or otherwise be placed in communication with the print station 1.

Figure 3:
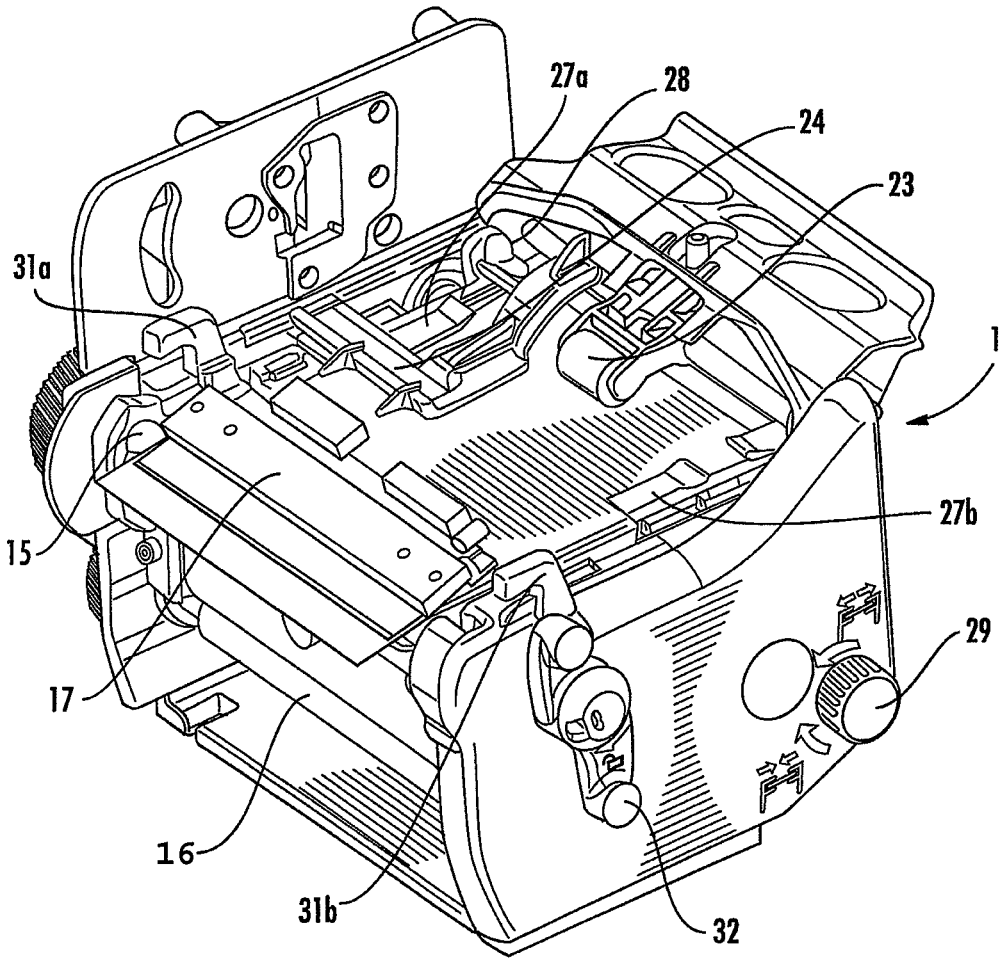
FIG. 3 is a perspective front view of a print station with a printhead assembly removed constructed in accordance with one example embodiment of the present disclosure.
Figure 4:
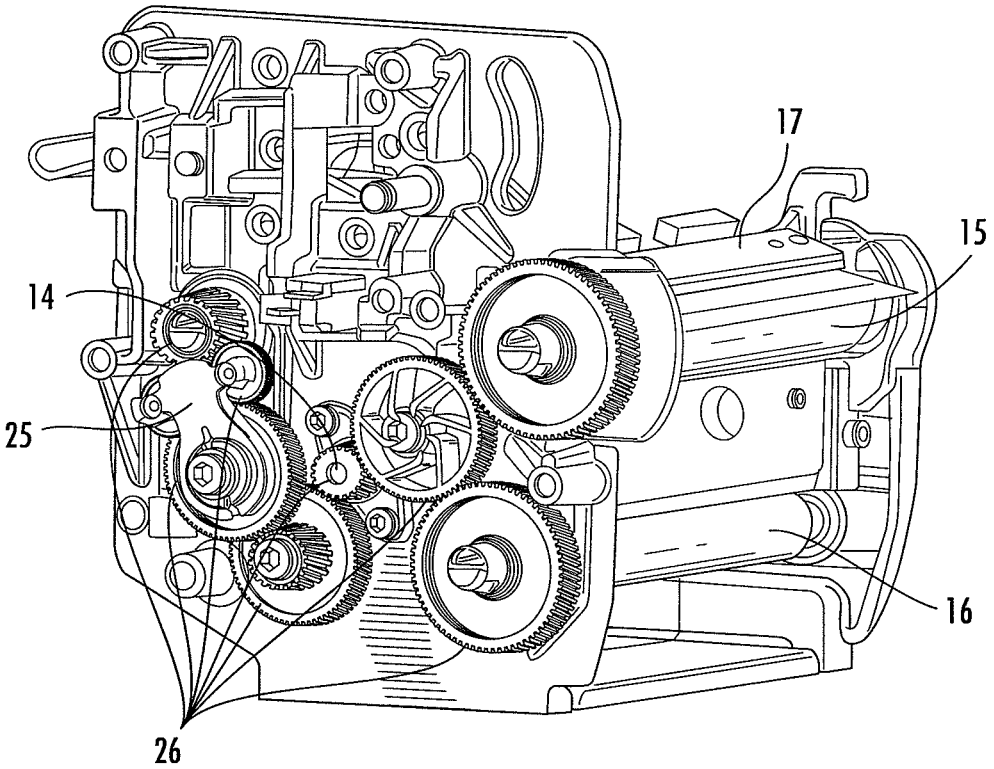
FIG. 4 is a perspective side view of the embodiment of FIG. 3.

The display panel 4 may be used to adjust all printing parameters of the print station system 10. Such parameters include, but are not limited to, print location on the media, control of a top-of-form sensor 24 (FIG. 3), and enabling or disabling optional printer features. Further, the display panel 4 may be used to adjust the torque of the motors in a ribbon drive assembly 12 and a media rewinder assembly 13 for unique media. The display panel 4 may also be used to adjust the amount of power delivered to each element of a printhead assembly 17 in the print station 1 from the power source 2.

The printer chassis 6 may provide a proper grounding for the electronic components of the print station system 10. Additionally, the chassis 6 may provide a structurally sound frame and housing for mounting components of the print station system 10.

The print station system 10 includes and aligns a media hanger/hub 7 with the print station 1. As a non-limiting example, a center of the media hanger/hub 7 may be aligned with a center of the print station 1.

Figure 15:
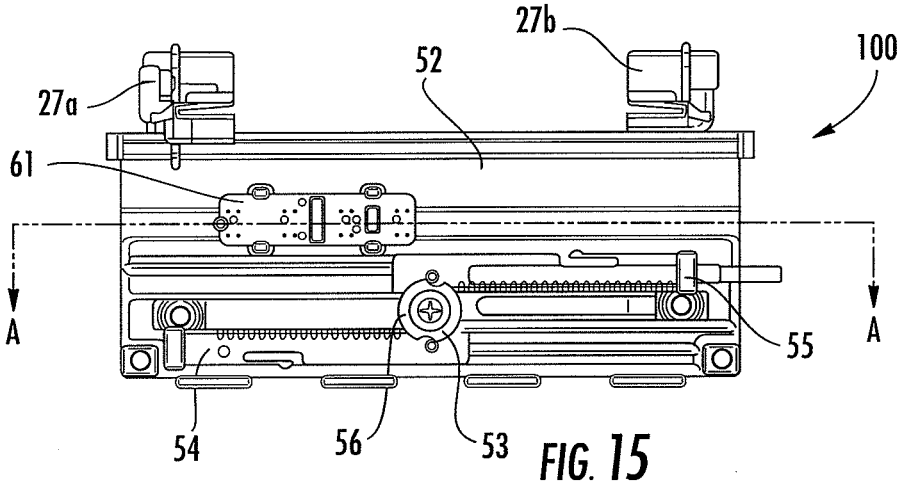
FIG. 15 is a rear plan view of the embodiment of FIG. 14.
Figure 16:
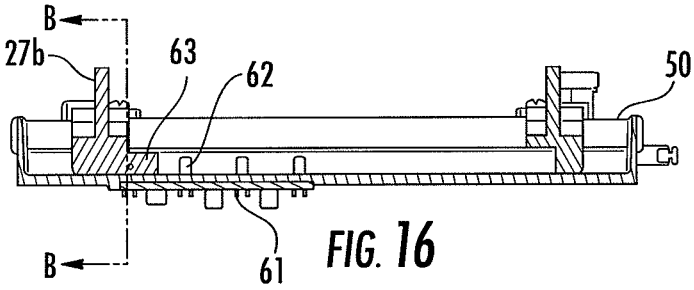
FIG. 16 is a cross-sectional view of the embodiment of FIG. 14.
Figure 17:
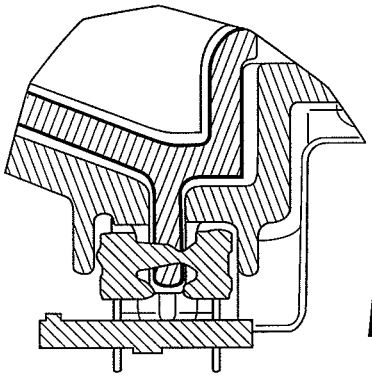
FIG. 17 is a cross-sectional view of the embodiment of FIG. 14 at the B-B axis with the media guides moved to a position such that a light beam emitted from a sensor is interrupted.
Figure 24:
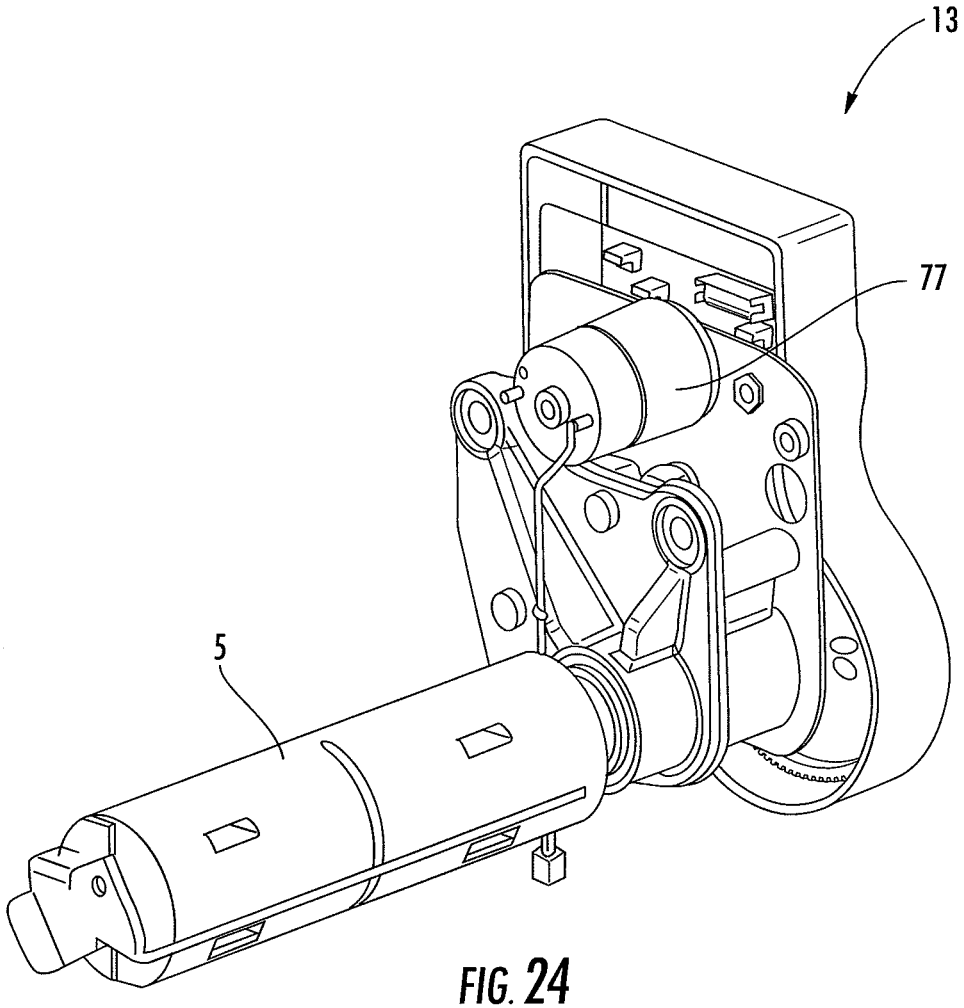
FIG. 24 is a perspective view of a media rewinder assembly.

Print station media width sensors 61 (FIG. 15) may measure the width of the media passing through the print station system 10 via the controller circuit card assembly 3. The media width information may be relayed to the ribbon drive assembly 12, which may then adjust the torque of drive motors 74, 75 (FIG. 21) in proportion to the width of the media. The media width information may also be relayed to the media rewinder assembly 13, which adjusts the torque of a motor 77 (FIG. 24) in proportion to the width of the media.

Further description as to the print station 1, media hanger/hub 7, ribbon drive assembly 12, and media width sensor 61 are provided below.

Print Station

Referring now to FIGS. 3-7, varying views of the print station 1 which is constructed in accordance with an example embodiment of the present disclosure is shown. The print station 1 generally includes a motor 14, a main platen roller 15, a lower platen roller 16, and a printhead assembly 17. The print station 1 may be easily inserted, removed from or otherwise incorporated into or integrated with a larger printer as desired, thereby permitting additional capabilities, functions, and options other than or in addition to those features provided by the print station 1. Thus, it will be appreciated by those skilled in the art that the print station 1 of the present invention is a modular or "stand alone" device.

Figure 5:
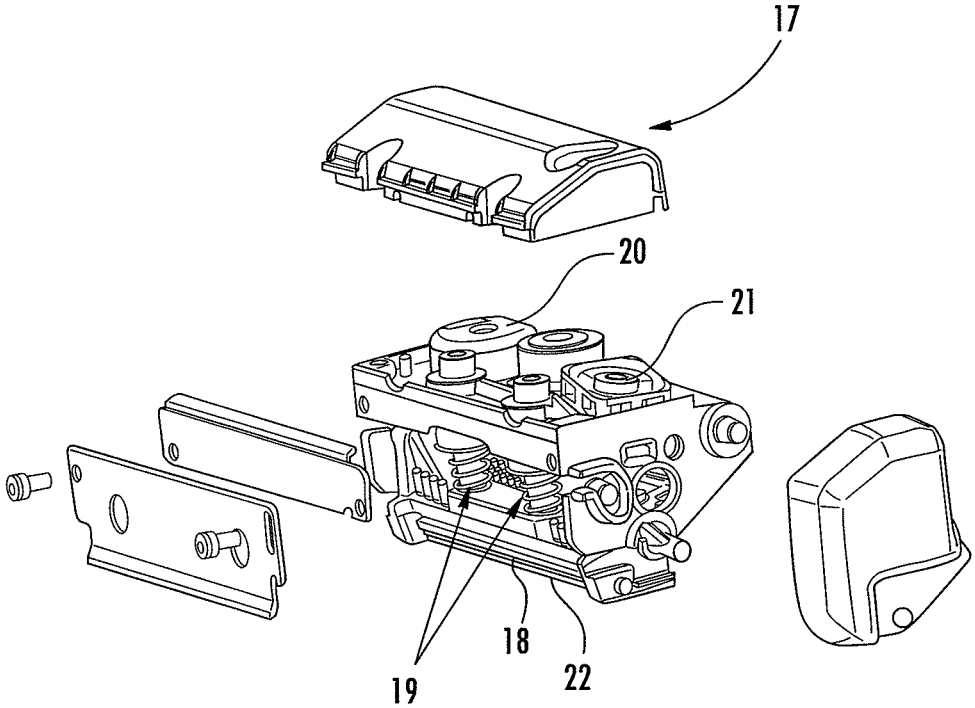
FIG. 5 is an exploded view of a printhead assembly constructed in accordance with one example embodiment of the present disclosure.
Figure 6:
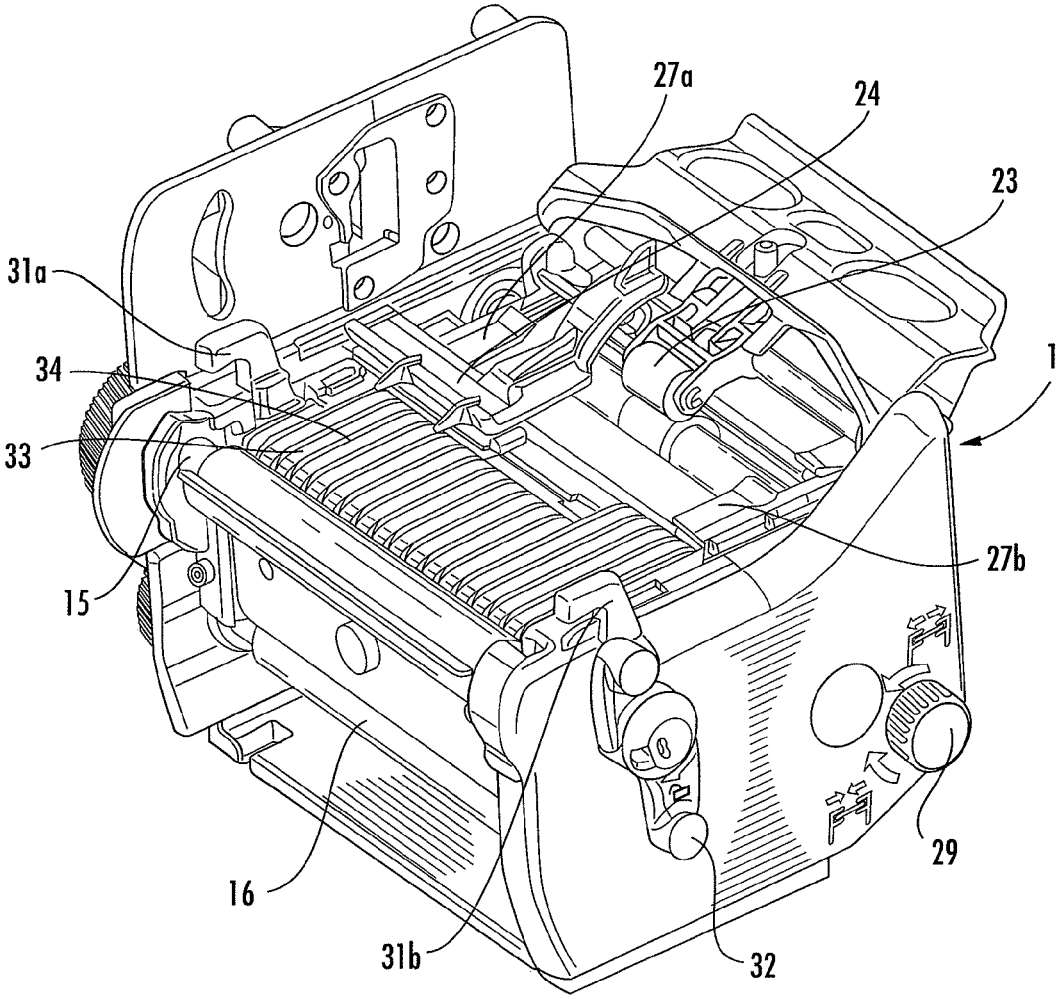
FIG. 6 is a perspective view of a print station with an RFID receptacle and RFID antenna constructed in accordance with one example embodiment of the present disclosure.
Figure 7:
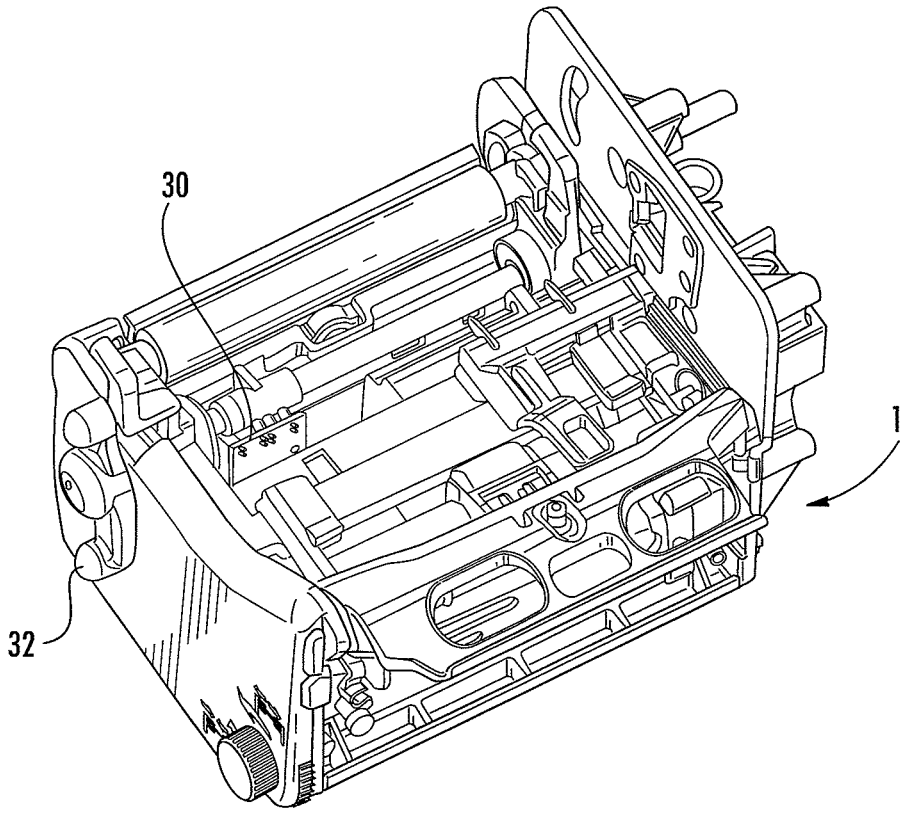
FIG. 7 is a perspective top view of an embodiment of a print station constructed in accordance with one example embodiment of the present disclosure.

In example embodiments and as best shown in FIG. 5, the printhead assembly 17 includes a thermal printhead 18, compression springs 19, a printhead pressure adjustment sensor 20 and a fan 21. The printhead pressure adjustment sensor 20 monitors, senses and determines the force within the compression springs 19. The fan 21 cools the thermal printhead 18 as needed. A temperature sensing member 22, such as a thermistor, may be located within the thermal printhead 18 to control overheating of the print station 1. The temperature sensing member 22 may be operatively coupled to a thermal heatsink to detect a thermal gradient generated therein. The temperature sensing member 22 may also be coupled to the control circuitry 3 of the print station system 10 which may adjust the target temperature of a heating element or may deactivate the heating element. The fan 21 may also be used to cool the thermal printhead 18.

In example embodiments, the print station 1 includes the main platen roller 15 and the lower roller 16. The main platen roller 15 is utilized for printing, while the lower platen roller 16 is utilized for assisting with the rewinding of media onto the rewind hub/assembly 5.

In example embodiments, the lower platen roller 16 may be slightly overdriven to maintain a tight media web between the main platen roller 15 and the lower platen roller 16. A tight media web is preferable for separating (or peeling) the labels off its corresponding backing.

The print station 1 also includes a pinch roller 23 and a top-of-form sensor 24. The top-of-form sensor 24 may be located between the main platen roller 15 and the pinch roller 23. The pinch roller 23 may be slightly underdriven to maintain a tight media web through the top-of-form sensor 24. When the print station 1 reverses direction during use, the pinch roller 23 is then slightly overdriven in order to maintain the media web tight through the top-of-form sensor 24. A rocker arm 25 and associated gears 26 permits movement of the print media in a forward and reverse direction.

The platen rollers 15, 16 and the pinch roller 23 may be easily removed and replaced in the event they become damaged during use or abuse of the print station 1.

In example embodiments, the top-of-form sensor 24 may be included in the print station 1 to determine a location of an initial portion of a web fed to the print station 1 and to properly align the printed information onto the media. The top-of-form sensor 24 may also determine and provide a signal when the initial portion of the web is located at a desired location within the print station 1. In an example embodiment, the top of form sensor 24 may be provided may be an optical sensor which includes a base hinged to a cover by a hinge. A flexible circuit is communicably fixed to the base and cover and may include an array of light emitting diodes (LEDs), photo sensors, and/or other notification and sensing means that permit for sensing indicators on media. The top of form sensor 24 may be capable of sensing any one of the following indicators: black marks on the top side or under side of the media, holes through or slots on the side of the media, top edges of label stock media, and any other errors, inconsistencies, or faults which may arise relative to positioning of and/or printing on the media. In exemplary embodiments, the top of form sensor 24 installed in the print station 1 and focused on a reserved area of a media web which is provided with a top of form mark. In exemplary embodiments, the sensor 24 may be connected to the control circuitry 3 via a interface connector to assist in achieving form alignment and determination of the presence of an unprinted media portion or label. The use of the interface connector provides a plug-in-play type set up and allows for easy removal for maintenance of both the print station 1 and the sensor 24.

Media guides 27*a*, 27*b* are included in the print station 1 and may be located prior to the pinch roller 23 to as to guide the media along a print station 1 center line. The media guides 27*a*, 27*b* each may contain media loading sensors 28 which may be used to inform the print station 1 that media is being fed into the print station 1. The print station 1 passes the information to the printhead pressure adjustment sensor 20 located within the printhead assembly 17. The printhead pressure adjustment sensor 20 may adjust the compression springs 19 for the appropriate force setting. Further description as to the media hanger 27*a*, 27*b* is provided below.

A media adjustment knob 29 is provided to adjust the width of the media guides 27*a*, 27*b*. Further, the media adjustment knob 29 may be self-locking, which would result in no longer requiring the print station 1 to lock the media guides 27 in position.

The motor 14 is provided to power the print station 1. The motor 14, which may be a drive-stepper motor, is geared to the platen rollers 15, 16 such that a full step of the motor 14 corresponds to a media movement. A non-limiting example of such media movement may be 1/300th of an inch. Continuing the non-limiting example, with a 300 dot per inch printhead assembly 17 such movement would result in a 300×300 dots per inch area of print. Additionally, the motor 14 may be operated in half-step mode. As a nonlimiting example of the results achieved using the half-step mode, the same gearing would result in a corresponding movement of 1/600th of an inch, with a 600 dot per inch printhead assembly 17 and 600×600 dots per inch area of print.

The motor 14 may be a direct current (DC) or alternative current (AC) driver motor, which may include an attached encoder disk that may be used to drive the print station 1. The print station 1 may establish a corresponding timing for 300, 600, or other dots per inch printing by determining the proper number of slots in the encoder disk.

A latch sensor 30 may be included to send a signal to the print station 1 of the position of the latches 31*a*, 31*b*. The latch sensor 30 may also sense when the latch 31*a*, 31*b* is closed, fully opened, or a variety of positions therebetween. A latch handle 32 permits manipulation of the latches 31*a*, 31*b* as desired.

The print station 1 may also include a receptacle 33 for mounting a radio-frequency identification (RFID) antenna 34. The receptacle 33 may be located prior to the main platen roller 15. The RFID antenna 34 may be used to imprint RFID data onto a chip embedded in a label. After the chip in the label is programmed with data, the label is then thermally printed. In the alternative, the RFID antenna 34 may be directly located on or incorporated in the print station 1.

Because the print station 1 is stand-alone, it may be easily inserted, removed from, or otherwise incorporated into or incorporated with a larger printer as desired, thereby permitting additional capabilities, functions, and options other than or in addition to those features provided by the print station 1.

Media Hanger

FIGS. 8-13 depict varying views and embodiments of the media hanger/hub 7 which may be utilized in the print station 1. Each media hanger/hub 7 may include a base plate 35 having a first surface 36 and a second surface 37 opposed to the first surface 36, at least one guide 38 extending into the second surface 37, a first support member 39 and a second support member 40 adapted for sliding movement along the at least one guide 38 relative to the base plate second surface 37, and a pivot 41 secured to the base plate second surface 37 and engaged with the support members 39 and 40 such that the pivot 41 is movable between a first position adapted for permitting insertion of a media (not shown) between the first support member 39 and the second support member 40 and a second position adapted for providing force on the first support member 39 and the second support member 40. A slot 42 may also extend into the second surface 37. An optional lock 43 may be movably secured to the base plate 35 for locking the first and second support members 39 and 40 in a predetermined position along the base plate 35.

The pivot 41 may include a link arm 44 extending therefrom. The point wherein the pivot 41 is rotatably secured to the base plate second surface 37 may be referred to as the pivot point. The link arms 44 are secured to the support members 39 and 40, with such connection preferably located at the distal ends of the link arms 44, although connections along other locations along the link arms 44 is also contemplated. A biasing mechanism is secured to the pivot 41 such that upon rotation of the pivot 41 at its pivot point to the second position, a compressive force is exerted so as to move the support members 39 and 40 toward one another along the guide 38. The biasing mechanism may be any type of biasing mechanism including, but not limited to, a torsion spring.

The support members 39 and 40 may include mounting plates 46 located on the bottommost portion of the support members 39 and 40. The mounting plates 46 are preferably sized and shaped so as to permit the support members 39 and 40 to movably slide along the guides 38 when the pivot 41 is manipulated. The link arms 44 are most preferably secured to the mounting plates 46 of the support members 39 and 40.

Figure 8:
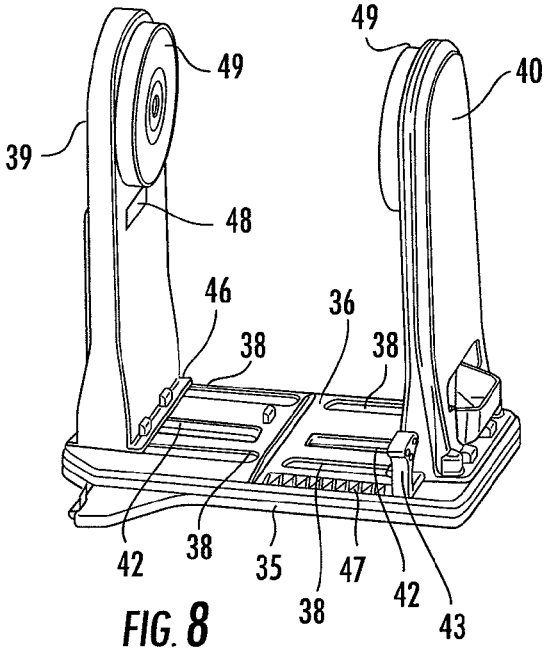
FIG. 8 is a perspective front view of a media hanger/hub in an open position in accordance with an exemplary embodiment of the present invention.
Figure 9:
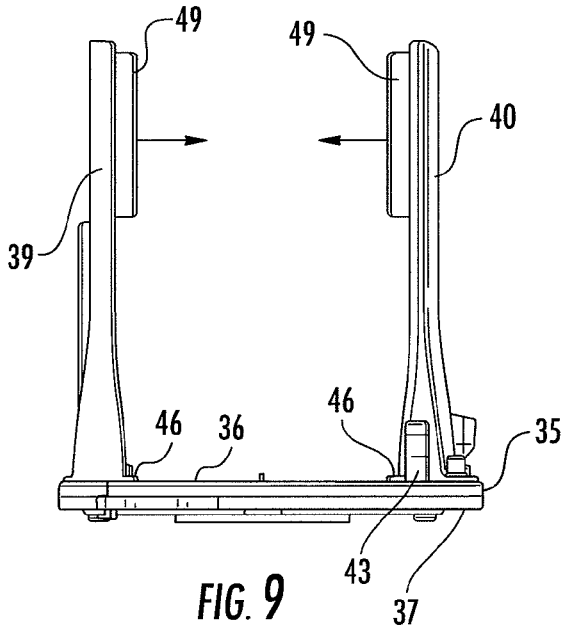
FIG. 9 is a front view of the embodiment of FIG. 8.
Figure 10:
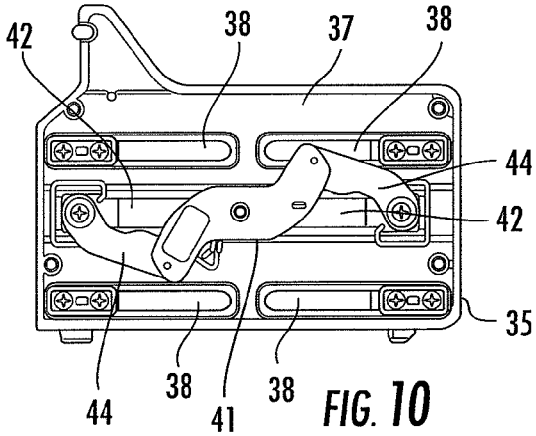
FIG. 10 is a bottom view of the embodiment of FIG. 8.

The lock 43 is utilized to hold the media hanger/hub 7 in an uncompressed position as shown in FIGS. 8-10. Notches 47 may be located on the base plate top surface 37. The notches 47 are sized and shaped so as to accommodate the lock 43 in a fixed position, thereby maintaining the support members 39 and 40 in the second position. Because a plurality of notches 47 are located on the first surface 36, the lock 43, and thus support members 39 and 40, may be manipulated such that the support members 39 and 40 may lock and remain in various positions along the guide 38 and relative to the base plate 35. Maintaining the support members 39 and 40 in various positions along the guide 38 is especially desired when using fan-fold media.

A sensor 48 may also be located on a support member 39 or 40. The sensor 48 is adapted to detect the presence and/or absence of media in the media hanger and is in communication with the control circuitry 3. The sensor 48 may be an optical sensor, a mechanical sensor, or another suitable sensor as known in the art. The presence or absence of media, as determined by the sensor 48, influences functions of a printer according to programming within the control circuitry. The sensor 48 may be used with roll media, although use of the sensor in conjunction with media of other types is also contemplated.

Additionally, the media hanger/hub 7 may include hubs 49 of varying sizes, including, but not limited to, 3", 1.5", 1", or a combination thereof. The hubs 49 may be fixed or interchangeable, and are used for holding media of various sizes.

Figure 11:
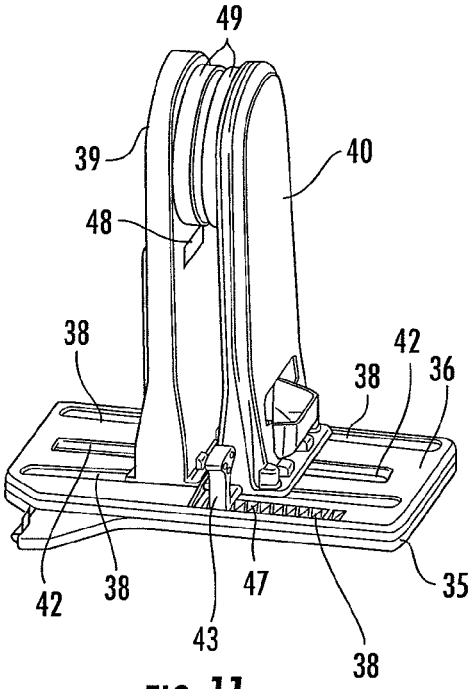
FIG. 11 is a perspective front view of the media hanger/hub in a compressed position in accordance with an exemplary embodiment of the present invention.
Figure 12:
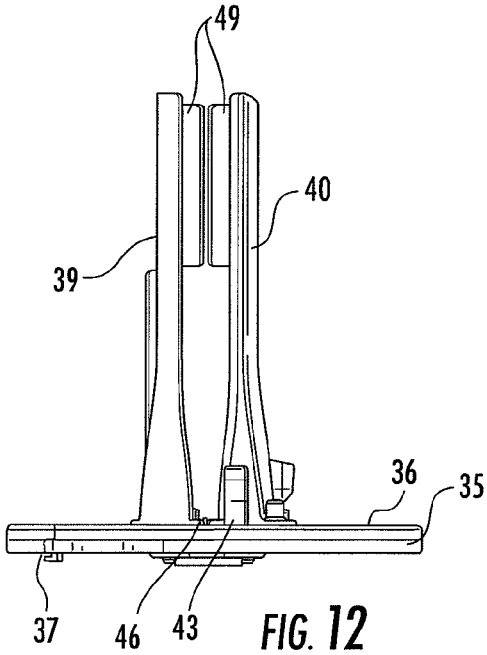
FIG. 12 is a front view of the embodiment of FIG. 11.
Figure 13:
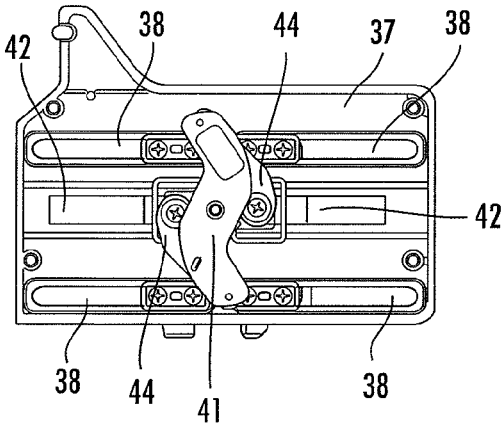
FIG. 13 is a rear view of the embodiment of FIG. 11.
Figure 14:
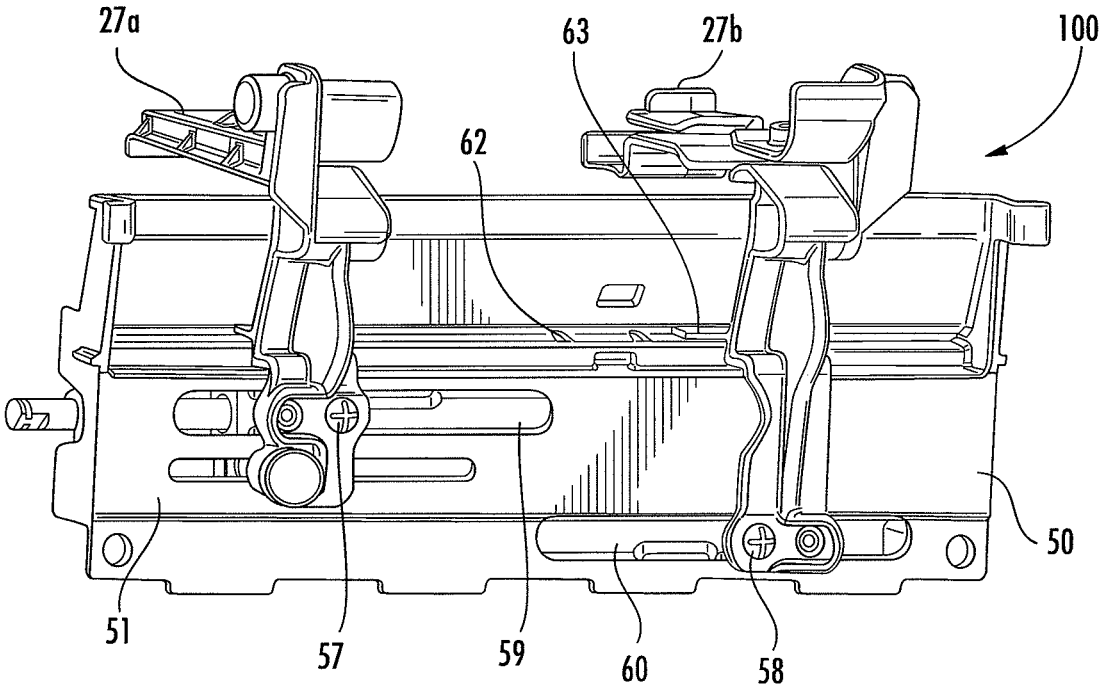
FIG. 14 is a perspective view of media guides in an open position in accordance with an exemplary embodiment of the present invention.

With specific reference to FIGS. 11-13, various views of the media hanger/hub 7 in a compressed position are shown. The compressed position is when compressive forces are applied to the first and second support members 39 and 40 so as to retain the media within the media hanger/hub 7. The compressed position is achieved by manipulating the pivot 41 such that the pivot 41 is rotated about its pivot point, thereby resulting in movement of the link arms 44 and, thus, exertion on the biasing mechanism.

A media is inserted within the media hanger/hub 7 when the distance between the support members 39 and 40 permit accommodation of the media. Such first position permits loading of rolled media, use of the media hanger/hub 7 for fan-fold media, or any other use of the media hanger/hub 7. The pivot 41 is then manipulated so as to move the support members 39 and 40 toward one another along the guide 38 to a desired distance between the support members 39 and 40. Such manipulation of the pivot 41 results in simultaneous and synchronized movement of the support members 39 and 40. Because such simultaneous and synchronized movement occurs, the media is centered within the media hanger/hub 7. Compressive forces applied on the media is constant, as opposed to linear, and such forces are not dependent upon the media width. The compressive forces are dependent upon a combination of factors, including, but not limited to, initial load on the biasing mechanism, the stiffness of the biasing mechanism, the pivot point geometry of the pivot 41, and the length of the link arms 44. The compressive force is a constant force and decreases vibration of the media, which in turns decreases the likelihood of the media rolling off of the media hanger/hub 7 and decreases the likelihood of blurred or offset printing.

Media Width Sensor

With reference to FIGS. 14-20, varying views of media guides 27*a*, 27*b* for feeding original image media and/or printable media into a print station system 10 and for determining the width of the inserted media at a print station 1 location are shown. In example embodiments and as shown in FIGS. 14-20, a printing system media feeding apparatus 100 is provided, including a base 50 to support media being fed into the system 100, the base 50 having top and bottom surfaces 51 and 52. First and second media guides 27*a*, 27*b* are provided about the bottom surface 52 of the base 50 extending outward and about a side of the base 50. The guides 27*a*, 27*b* are movably attached to the base 50 such that they are operable to engage opposite sides of the media being fed between the guides.

In example embodiments, both guides 27*a*, 27*b* are slidable along a horizontal axis (A-A) of the base 50 in synchronism via a rack and pinion system 53 and when pushed together, the guides 27*a*, 27*b* centrally register the inserted media and help ascertain the width thereof. More specifically, the guides 27*a*, 27*b* are mounted to first and second racks 54 and 55 coupled by a pinion gear 56 on the top surface 51 of the base 50 that cooperatively provide for synchronous translation of the guides 27*a*, 27*b* in a rack and pinion arrangement by which the guides 27*a*, 27*b* can be pushed together to centrally register the media. In example embodiments, the rack and pinion system 53 is located about the top surface 51 of the base 50 and is connected to the guides 27*a*, 27*b* via screws 57, 58, that extend through the base 50 at predefined slots 59, 60.

The printing system 100 may further include a media width sensing apparatus or sensor 61 providing electrical signals used to ascertain the width of registered media between the media guides 27*a*, 27*b*. The sensor 61 is mounted in a fixed position relative to the top surface 51 of the base 50 and the guides 27*a*, 27*b*. The sensor 61 is adapted to detect the presence and/or absence of an obstruction and is in communication with control circuitry (not shown). In an example embodiment, the control circuitry determines the width of the media based on signals received from the sensor 61. In one embodiment, control circuitry includes a microcontroller with associated memory. The control circuitry may oversee movement of the media sheet along the entire media path, or may just determine the width of the media as it moves through the print station and about the sensor 61.

The sensor 61 may be an optical sensor, a mechanical sensor, or another suitable sensor as known in the art. In an example embodiment shown herein, the sensor 61 is an optical sensor. The sensor 61 is provided with at least one light emitting device which is operable for emitting at least one light beam through at least one aperture 62 of the base 50. The sensor 61 is operable for detecting an obstruction to the emitted light beam and includes a transmitter (not shown) and a receiver (not shown). The transmitter emits a signal that is detectable by receiver. In one embodiment, the signal is electromagnetic energy. Thus, the transmitter emits optical energy with a frequency spectrum that is detectable by receiver. The transmitter may be embodied as an LED, laser, bulb or other source. The receiver changes operating characteristics based on the presence and quantity of optical energy received. The receiver may be a phototransistor, photodarlington, or other detector. The optical energy may consist of visible light or near-visible energy (e.g., infrared or ultraviolet). The presence or absence of an obstruction, as determined by the sensor 61, influences functions of a printer according to programming within the control circuitry. The sensor 61 may be used with roll media, although use of the sensor in conjunction with media of other types is also contemplated. Also, in exemplary embodiments, the media width resolution of the sensor 61 is:

$$\text{Res}=(\text{Max. media width}-\text{Min. media width})/(2*N-1),$$

where N is the number light beams emitted by the sensor

At least one of the media guides 27*a*, 27*b* include an optical obstruction structure (a tab) 63 that is operatively coupled to the movable media guide 27*a*, 27*b* so as to move relative to at least one of the light beams emitted by the sensor 61 when the media guide 27*a* and/or 27*b* is moved relative to the base 50 with the tab 63 moving within a sensing gap (over the emitted light beam coming through the aperture) to block or otherwise interrupt the signal path.

Figure 18:
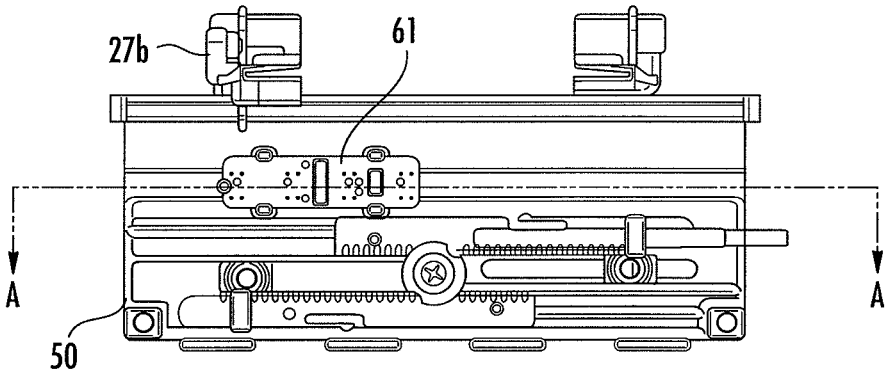
FIG. 18 is a rear plan view of the embodiment of FIG. 14.
Figure 19:
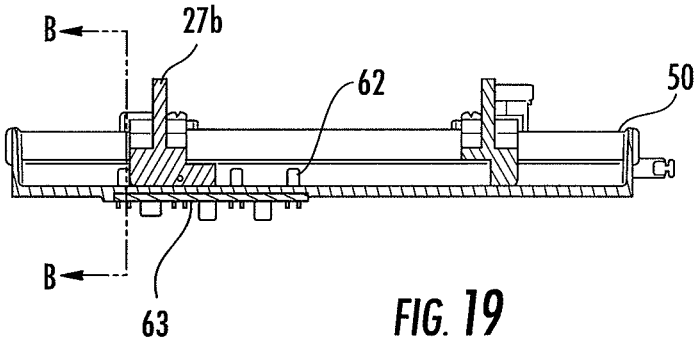
FIG. 19 is a cross-sectional view of the embodiment of FIG. 14.
Figure 20:
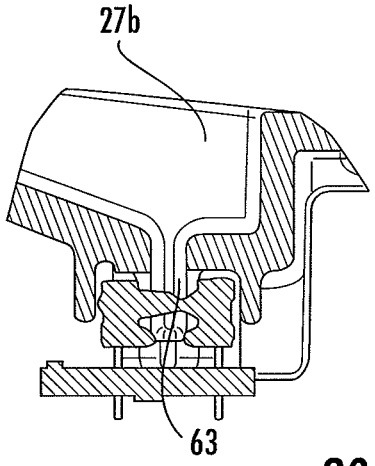
FIG. 20 is a cross-sectional view of the embodiment of FIG. 14 at the B-B axis with the media guides moved inward to a second position such that a light beam emitted from a sensor is interrupted.

FIGS. 14-17 illustrate the media guides 27*a*, 27*b* in a fully open position such that one of the light beams of the sensor 61 are blocked or otherwise obstructed. Referring now to FIGS. 18-20, the guides 27*a*, 27*b* are moved inward along the horizontal A-A axis of the base 50 such that tab 63 blocks an additional light beam emitted from sensor 61. Upon further closure of the media guides 27*a*, 27*b* additional light beams will be blocked, thereby providing the control circuitry with additional information to be used in the determination of the media width.

Further example embodiments provide a method for determining a media width in a print station system 10. The method comprises providing a base with first and second media guides, mounting a sensor in a fixed position relative to the print station. The base within the print station 1 being provided with at least one aperture for permitting emitted light beams from the sensor to pass through. At least one media guide 27*a*, 27*b* is provided with an optical obstruction structure such as a tab or fin which is located in a fixed position relative to the media guide 27*a*, 27*b* to move relative to the emitted light beam when the media guide 27*a*, 27*b* is moved relative to the print station 1. The media guide 27*a*, 27*b* is then moved to register the media and electrical signals are read from the sensor 61, with the media width being determined based at least partially on the electrical signals. In certain implementations, the width determination may include determining two or more possible media widths based on the electrical output signals from the sensor, rendering a selection of the plurality of possible media widths to a user, and determining the media width based on a user selection from a user interface of the print station system 10.

Ribbon Drive Assembly

Figure 21:
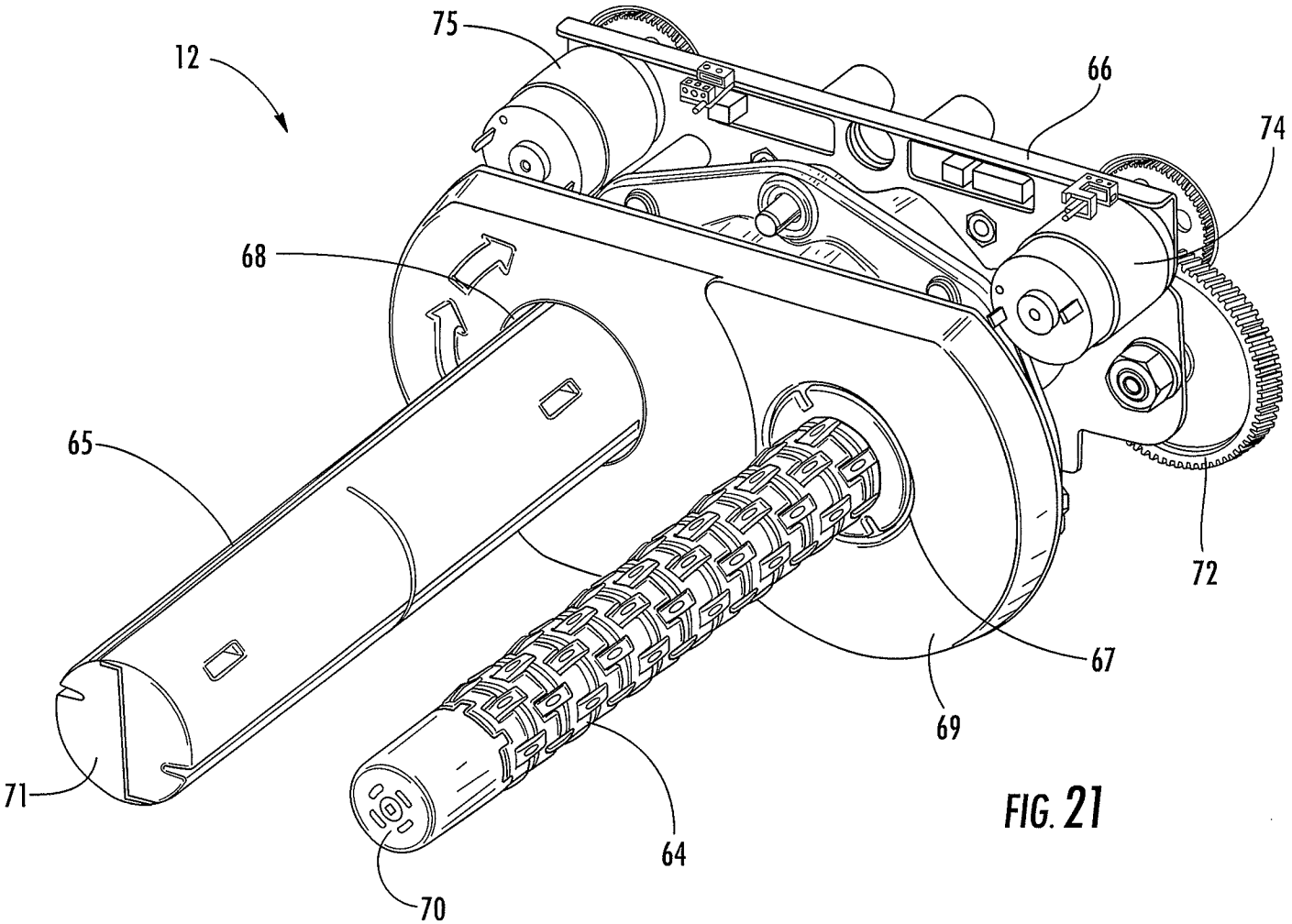
FIG. 21 is a perspective front view of the ribbon drive assembly in accordance with an exemplary embodiment of the present invention.
Figure 22:
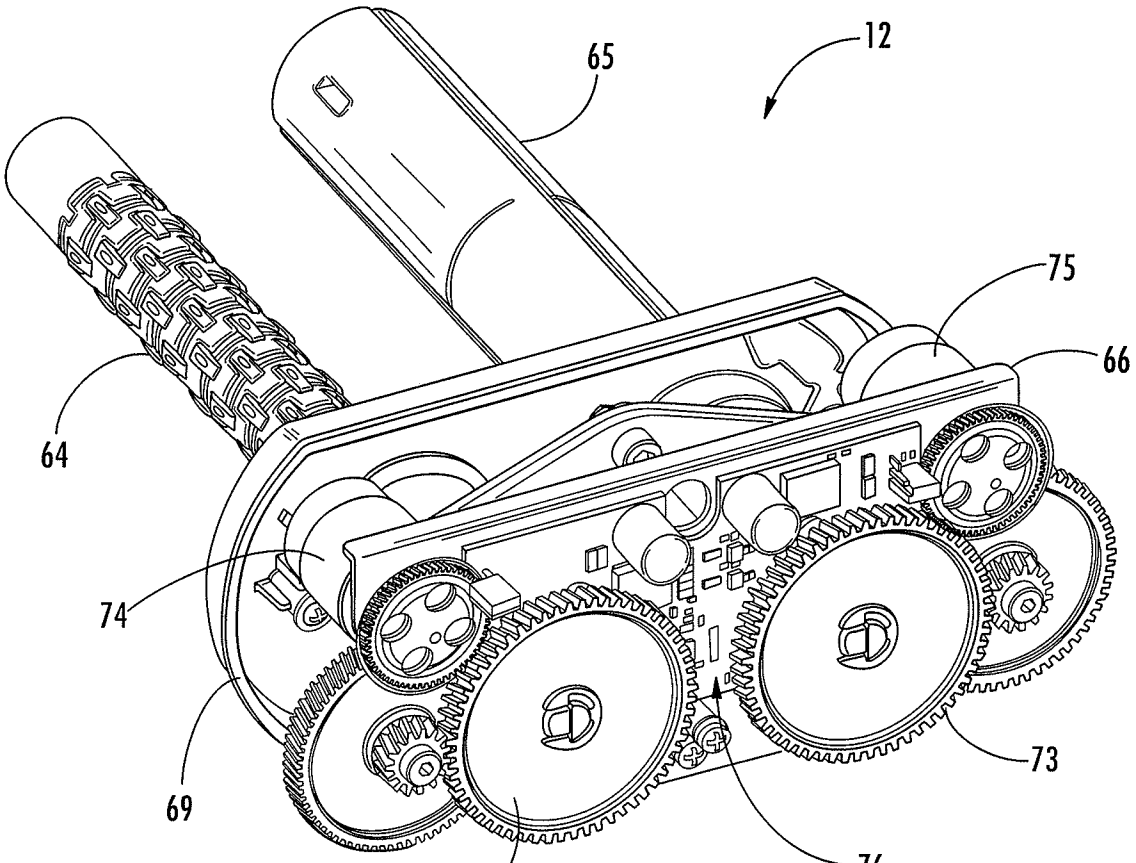
FIG. 22 is a perspective rear view of the embodiment of FIG. 21.
Figure 23:
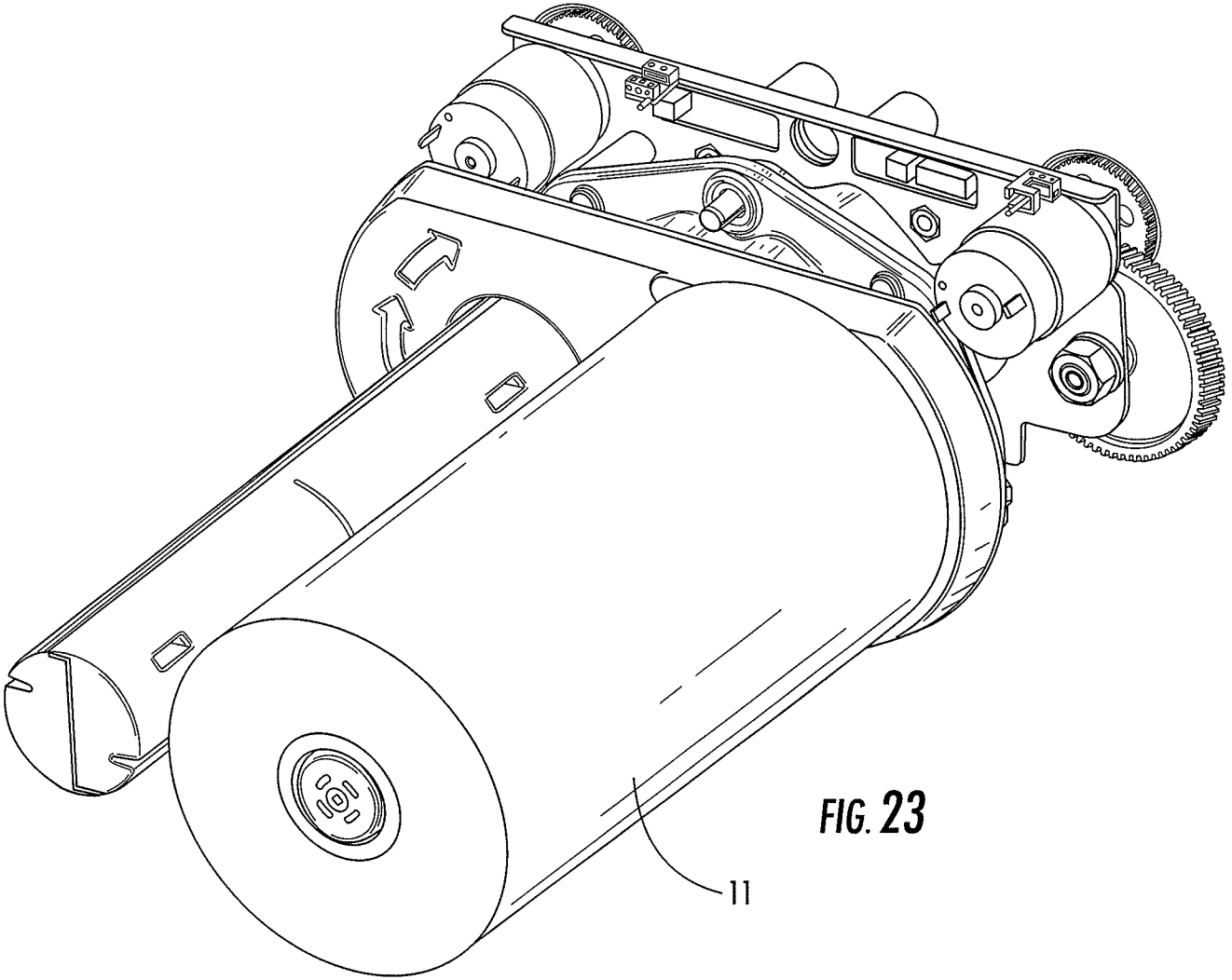
FIG. 23 is a perspective back view of the ribbon drive assembly with a ribbon supply on the supply spindle located thereon.

Referring now to FIGS. 21-23, a ribbon drive assembly in accordance with example embodiments is shown. In all example embodiments, a ribbon drive assembly 12 is provided for maintaining a constant tension on a ribbon supply 11 as it peels off a supply spindle 64 into the print station 1 and is metered off onto a take up spindle 65.

In example embodiments, the spindles 64, 65 are rotatably connected to a base plate 66 at one end and extend through a port 67, 68 of a cover plate 69 such that their respective distal ends 70, 71 are operative for receiving a roll of ribbon supply 11. Each spindle 64, 65 is provided with an independently operated drive system comprising a plurality of gears 72, 73 for rotating the spindles 64, 65, a motor 74, 75 for driving the plurality of gears 72, 73 in either a clockwise or counter clockwise direction, and a rotary encoder (60 pulses/rev). In example embodiments, the drive system is connected to the base plate 66. In example embodiments, the plurality of gears 72, 73 have a 23:1 gear reduction. It will be understood by those skilled in the art that it is contemplated that the motor 74, 75 will be a DC motor however, any type of motor suitable for powering the gears 72, 73 and spindles 64, 65 in a rotary movement may be employed. Further, in example embodiments, the motors 74, 75 are independently operated to optimize ribbon tension.

The drive system further comprises a circuit board 76 connected to the base plate 66 having a control processor for each motor 74, 75 which is attached to a side of the base plate 66. The electronics of the circuit board 76 similarly have two sets of drive components for each spindle 64, 65. In example embodiments, the drive system uses a Cypress PSoC3 which is a 8051 processor core with on chip programmable digital and analog functions and communication components. However, it will be understood by those skilled in the art that a variety of processors may be used. The processor, motor drive IC's, and opto encoders and associated circuitry are located on the single board 76 of the drive system. The bulk of the electrical components such as pulse width modulators, timers, ADC converter and other logic are programmed directly in to the PSoC part using its' system on a chip capabilities. The processor of the drive system is communicatively linked with the control circuitry 3 via a SPI bus. Firmware updates to the drive system's processor may be made using a boot loader that communicates over an I2C bus.

To maintain constant ribbon tension throughout operation of the print station 1, the torque of the motors 74, 75 are continuously adjusted. The torque produced by a motor is directly proportion to the average motor current. Therefore the drive systems ultimately regulate motor current. The control circuitry 3, via a defined message frame, informs the drive system of current feed speed, target feed speed, move direction, supply and take up tension settings. The drive system responds back to control circuitry 3 with current status, the supply ribbon radius, and the current firmware revision of the drive system. The drive system parses incoming message frames and then runs a motion control state of the printer. Based on feed direction, current speed, and target speed, the printer state transitions through various operating states such as idle, ramping up, constant velocity, ramping down, and back to idle. These states align to what the control circuitry 3 is doing with a motor operable for controlling the platen rollers 15, 16.

The drive system calculates the supply spindle 64, 65 radius and the take up spindle 65 radius by using the current speed information from the main processor and angular velocity information obtained from the rotary encoder. The radius information is then used to determine the required torque level of each motor 74, 75 to produce the tension level as requested by the control circuitry 3. The output of this torque calculation is the steady state motor current Setpoint (SP) which is maintained by a Proportional Integral (PI) control system.

In example embodiments, two independent control systems, one for each motor 74, 75, are executed every 500 us seconds. Each time the control systems run they adjust the Pulse Width Modulated (PWM) duty cycle which drives an H-Bridge motor IC's. The duty cycle of the PWM ultimately controls the average motor current, hence torque.

The embodiments described above provide advantages over conventional devices and associated methods of manufacture. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Furthermore, the foregoing description of the preferred embodiment of the invention and best mode for practicing the invention are provided for the purpose of illustration only and not for the purpose of limitation—the invention being defined by the claims.

What is claimed is:

1. A print station system for use with a thermal transfer printer comprising:

a chassis for housing a modular print station;

a display panel disposed in the chassis and being in signal communication with the modular print station;

a ribbon drive assembly located in the chassis and being operable for maintaining a ribbon supply;

a media rewind hub located in the chassis;

a pair of adjustable media guides connected about a base of the modular print station, the adjustable media guides being axially spaced apart along the length of the base and being configured and adapted such that they can be manipulated or moved along a horizontal axis of the base in a sliding manner and in a synchronized manner;

a power source in communication with the modular print station, the display panel, the ribbon drive assembly, the adjustable media guides, and the media rewind hub;

control circuitry located in the chassis and being in signal communication with the modular print station, the display panel, the ribbon drive assembly, the adjustable media guides, and the media rewind hub, wherein a sensor is affixed to the base, the sensor being operable for emitting at least one light beam through at least one aperture located in the base, wherein at least one of the adjustable media guides is provided with a tab which protrudes into the path of at least one of the at least one light beams emitted from the sensor at defined locations, thereby signaling the sensor and the printer of a media's width; and wherein the control circuitry is configured to adjust a torque of the ribbon drive assembly in proportion to the media's width.

2. The print station system of claim 1, wherein the modular print station comprises:

a motor mounted within the chassis and connected to the control circuitry;

a platen roller assembly configured to have a media web pass therethrough and being in operative communication with the motor and the control circuitry;

a pinch roller in operative communication with the motor;

a top-of-form sensor located between the platen roller assembly and the pinch roller, wherein the top-of-form sensor senses indicators on the media web;

a rocker arm in operative communication with the platen roller assembly and the pinch roller;

a printhead assembly;

a media width sensing and guide device having a pair of adjustable media guides and at least one media width sensor in communication with the printhead assembly for guiding the media through the system; and a radio-frequency identification antenna substantially located between the main platen roller assembly and the pinch roller.

3. The print station system of claim 2, wherein the motor is a drive stepper motor.

4. The print station system of claim 2, wherein the printhead assembly comprises:

a thermal printhead;

at least one compression spring; and a printhead pressure adjustment sensor in communication with the at least one compression spring.

5. The print station system of claim 4, wherein the printhead pressure adjustment sensor monitors, senses and determines a force being applied to the at least one compression spring during a printing operation.

6. The print station system of claim 2, wherein the platen roller assembly is comprised of a main platen roller and a lower platen roller and wherein the main platen roller is configured for printing operations and the lower platen roller is configured for assisting with the rewinding of media into the media rewind hub.

7. The print station system of claim 6, wherein the lower platen roller may be slightly overdriven during a printing operation to maintain the media web taught as the media web moves through the print station system.

8. The print station system of claim 2, wherein the pinch roller may be underdriven by the motor during a printing operation to maintain the media web taught as the media web moves through the top-of-form sensor.

9. The print station system of claim 2, wherein the top-of-form sensor is an optical sensor.

10. The print station system of claim 9, wherein the top-of-form sensor is comprised of a base hingedly fixed to a cover, a flexible circuit communicably fixed to the base and cover and an interface connector communicably connected to the control circuitry, wherein the flexible circuit comprises a plurality of sensing means that permit the sensing of indicators on the media.

11. The print station system of claim 2 further comprising a latch sensor configured for sensing information relating to the position of the chassis and communicating the information to the control circuitry.

12. The print station system of claim 1, wherein the ribbon drive assembly comprises:

a base plate;

first and second rotatable spindles configured to receive a ribbon supply, said rotatable spindles being rotatably connected to the base plate such that each spindle can rotate in either a clockwise or counter clockwise direction;

a first drive system connected to the base plate and coupled the first spindle and being configured to rotate the first spindle, said first drive system having a plurality of gears for rotating the first spindle, a motor for driving the plurality of gears in either a clockwise or counter clockwise direction, and a rotary encoder; and control means coupled to the motor of the first drive system and being operative for independently controlling the drive direction of the first rotatable spindle so as to substantially maintain a constant ribbon tension on the ribbon supply.

13. A print station system operable for use with a thermal transfer printer, comprising:

a modular image forming device configured for installation in and removal from a printing system, the modular image forming device comprising a motor mounted within a housing, a platen roller assembly configured to have a media web pass therethrough and being in operative communication with the motor and control means, a pinch roller in operative communication with the motor, a top-of-form sensor located between the platen roller assembly and the pinch roller, wherein the top-of-form sensor senses indicators on the media web, a rocker arm in operative communication with the platen roller assembly and the pinch roller, a printhead assembly, a media width sensing and guide device having a pair of adjustable media guides and at least one media width sensor in communication with the printhead assembly for guiding the media through the system, and a radio-frequency identification antenna substantially located between the platen roller assembly and the pinch roller; a power source in communication with the modular image forming device;

a controller circuit card assembly in communication with the modular image forming device and the at least one media width sensor;

a display panel in communication with the modular image forming device, the control circuitry and the power source; a chassis for housing the modular image forming device;

a media rewind hub located in the chassis;

a ribbon drive assembly;

a pair of adjustable media guides connected about a base of the modular image forming device, and the adjustable media guides; and a sensor affixed to the modular image forming device base, wherein the controller circuit card assembly is configured to adjust a torque of the ribbon drive assembly based at least in part upon the at least one media width sensor.

14. The print station system of claim 13, wherein the printhead assembly comprises:

a thermal printhead;

at least one compression spring; and a printhead pressure adjustment sensor in communication with the at least one compression spring.

15. The print station system on of claim 14, wherein the printhead pressure adjustment sensor monitors, senses and determines a force being applied to the at least one compression spring during a printing operation.

16. The print station system of claim 13, wherein the platen roller assembly is comprised of a main platen roller and a lower platen roller and wherein the main platen roller is configured for printing operations and the lower platen roller is configured for assisting with the rewinding of media into the media rewind hub.

17. The print station system of claim 15, wherein the lower platen roller may be slightly overdriven during a printing operation to maintain the media web taught as the media web moves through the print station system.

18. The print station system of claim 13, wherein the ribbon drive assembly comprises:

a housing comprised of a base plate connected to a cover plate, said cover plate having a pair of ports disposed therethrough;

a supply spindle and a take up spindle rotatably connected to the base plate and extending through the pair of ports such that the spindles can receive a ribbon supply;

a first drive system connected to the base plate and coupled the supply spindle, said first drive system having a plurality of gears for rotating the supply spindle, a motor for driving the plurality of gears in either a clockwise or counter clockwise direction, and a rotary encoder; and control means coupled to the motor of the first drive system for controlling the drive direction of the supply rotatable spindle.

19. The print station system of claim 13, wherein the top-of-form sensor is an optical sensor.

20. A print station system operable for use with a thermal transfer printer, comprising:

a chassis;

a modular print station removably installed within the chassis;

a power source in communication with the modular print station;

a controller circuit card assembly in communication with the modular image forming device;

a display panel in communication with the modular image forming device, the controller circuit card assembly, and the power source;

a media rewind hub located in the chassis;

a ribbon drive assembly; and a pair of adjustable media guides connected about a base of the modular image forming device, the adjustable media guides including a media width sensor in communication with the controller circuit card assembly, wherein the controller circuit card assembly is configured to adjust a torque of the ribbon drive assembly based at least in part upon the media width sensor.

* * * * *